United States Patent [19]

Mitgau et al.

[11] 3,935,336

[45] Jan. 27, 1976

[54] PROCESS FOR MAKING CARRIER SHEETS IMPREGNATED WITH AMINOPLAST CONDENSATION RESINS

[75] Inventors: Rötger Mitgau, Essen-Kupferdreh; Bruno Petrik, Essen; Dietmar Schedlitzki, Niederwenigern, all of Germany

[73] Assignee: Th. Goldschmidt AG, Germany

[22] Filed: Feb. 16, 1973

[21] Appl. No.: 333,311

[30] Foreign Application Priority Data

Mar. 9, 1972 Germany ..... 2211312

[52] U.S. Cl. ..... 427/173; 427/374; 427/391

[51] Int. Cl.[2] ..... D06M 13/54

[58] Field of Search ..... 156/229, 331, 244; 162/136; 117/155 R, 161 UA, 161 UN, 7, 155 L, 161 L, 161 LN; 427/173, 176, 391, 374

[56] References Cited

UNITED STATES PATENTS

| | | | |
|---|---|---|---|
| 3,318,749 | 5/1967 | Califano et al. | 156/229 |
| 3,431,162 | 3/1969 | Morris | 162/136 |
| 3,616,197 | 10/1971 | Amberg et al. | 156/331 |
| 3,620,797 | 11/1971 | Feitlowitz | 117/7 |
| 3,637,409 | 1/1972 | Hartman | 117/7 |
| 3,720,573 | 3/1973 | Mayer | 156/229 |

*Primary Examiner*—Douglas J. Drummond
*Assistant Examiner*—Jerome W. Massie
*Attorney, Agent, or Firm*—James E. Bryan

[57] ABSTRACT

A process for making carrier sheets of paper, treated with aqueous solutions of heat-hardenable, aminoplast condensation resins, such as, the reaction products of melamine, urea, thiourea, and like aminoplast constituents with formaldheyde, in which the treated sheet is stretched, as by passing it over broad-drawing rollers while it is in a warm-deformable condition (at a temperature between about 80° to 130°C), transversely with respect to the grain of the paper and, if desired, longitudinally with respect to the grain of the paper, and the treated stretched sheet is then cooled to a temperature of about 30°C by blowing with air or passing the same over cooling rollers. The treated sheet may be stretched after it has passed through a heated drying channel, to dry and procondense the heat-hardenable aminoplast condensation resin, and before the temperature has dropped below that at which the sheet is no longer in a warm-deformable condition or the sheet may be cooled after passage through the heated drying channel and then reheated to a warm-deformable condition. The treated, stretched sheets of the present invention are pressed on wood panels in a heated hydraulic press and preferably in a heated short-cycle press.

9 Claims, 1 Drawing Figure

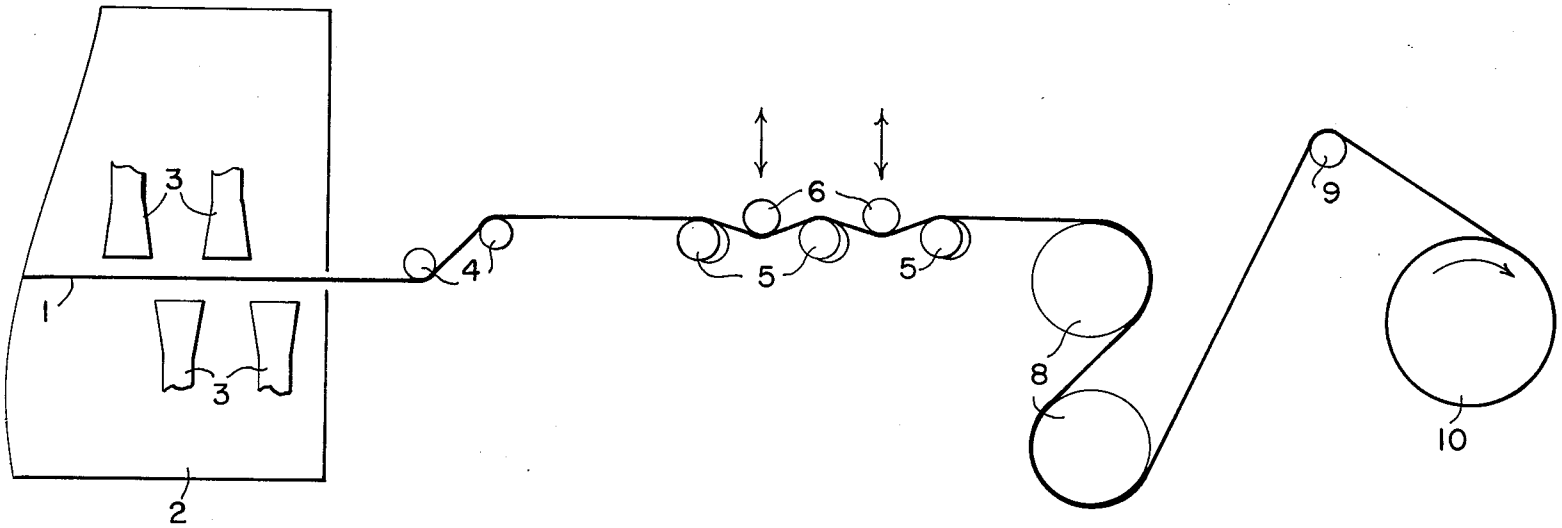
1
2
3
3
4
5
5
6
6
8
9
10

PROCESS FOR MAKING CARRIER SHEETS IMPREGNATED WITH AMINOPLAST CONDENSATION RESINS

The present invention relates to a process for making or preparing carrier sheets of paper impregnated and/or coated with aqueous solutions of heat-hardenable aminoplast condensation resins, preferably for the surface treatment or improvement of wood plates or panels in short-cycle presses.

For the surface treatment or improvement of wood plates in particular, it is known to use aminoplast condensation resins which, since they are not adapted to form self-supporting foils, are applied to carrier sheets, usually of paper. The term aminoplast condensation resin is understood to mean the reaction products of melamine, urea, thiourea, or similar aminoplast constituents with formaldehyde. The condensation resins are condensed up to a specific compatibility with water and thereupon applied as a predominantly aqueous solution onto carrier sheets. These carrier sheets are impregnated with the solutions of the condensation resins and, depending upon the quantity and concentration of the resin solutions employed, are coated either on one side or on both sides thereof, either simultaneously or by passing the pre-saturated or pre-impregnated carrier sheet through a second impregnating tub. The carrier sheets impregnated in this manner and coated, if desired, are passed through a heated drying channel in such a manner that the heat-hardenable synthetic resins are dried and precondensed, while, however, the capability to flow and the chemical reactivity are still maintained. After leaving the drying channel, the sheets are cooled by blowing with air or by means of cooling rollers, and are rolled up or cut to formats having the desired size. The products from this process are semifinished goods and, particularly for the surface treatment of wood panels or plates, such as, for example, plywood panels, chip plates, and the like, are pressed upon the surfaces of these plates at elevated temperature. At that time, the condensation resin forms a closed surface while simultaneously becoming bonded to the base where it hardens completely.

Pressing of the carrier sheets containing the heat-hardenable synthetic resin onto the upperside and underside of the plates to be treated or improved takes place in heatable hydraulic presses.

It was heretofore customary to compose or stack together, the press packages having, for example, the following layering:

- press sheet steel
- one or several layers of carrier sheets containing condensation resin
- wood panel
- one or several layers of carrier sheets containing condensation resin
- press sheet steel outside of the press, if desired, with the additional insertion of a press cushioning or padding, and then to drive in or introduce them into the press, which latter was subsequently heated and placed under pressure. After the completion of the hardening reaction, recooling was effected and the pressed material removed or driven out.

In order to shorten the coating process, so-called short-cycle presses have been used for some time, in which the press steel sheets are secured to the heated press and remain constantly heated and wherein merely the press package, having the following stratification:

- one or several layers of carrier sheets impregnated with condensation resin
- wood panel
- one of several layers of carrier sheets impregnated with condensation resin is driven into or introduced in the open short-cycle press and deposited on the lower heated press steel sheet. At that time, it cannot be avoided that the carrier sheets containing resin, which are positioned on the lower press steel sheet, will begin to condense, due to the action of the heat, before the press is placed under pressure. Simultaneously, it cannot be avoided that the lower layer of the resin-carrying carrier sheets come into contact with the lower heated press steel sheet for an unevenly long period of time since, during the removal of the conveying device, the front batches or series of the lower carrier sheet, having been deposited on the press steel sheet, remain in contact with the hot press steel sheet longer than the batches or series which had been deposited last. The consequence thereof is an undesirable premature condensation, particulary of the batches or series which were deposited on the steel sheet first. Since the condensation takes place without pressure, the resin will foam up at the points which are exposed longer. Therefore, there will sometimes appear, at the underside of a finished compressed plate, irregularities in the opacity which considerably impair the appearance and usability of the treated plates. In this connection, it is not necessary that irregularities in the outer condition be visible in the unpressed resin-carrying carrier sheet.

The present invention aims at proposing and providing carrier sheets, impregnated and/or coated with the afore-mentioned heat-hardenable synthetic resins, which do not show these irregularities in the finished pressed condition thereof and, when used in short-cycle presses, furnish perfect surfaces on the underside of the plates.

It has now been surprisingly found that the irregularities on the surface of the undersides, in short-cycle presses, of treated or improved wood panels or plates will not arise if the carrier sheets, impregnated and coated with resin, are stretched or elongated transversely, after drying and preliminary condensation in the still warm-deformable condition, and, if desired, lengthwise to the grain direction and thereafter cooled.

If desired, a film leaving the drying channel, and whose temperature is below the temperature of the warm-deformable stage or condition, may be heated in a suitable manner prior to the stretching or elongation.

It is assumed that stresses in the film, which inevitably arise due to irregularities and/or inhomogeneities of the paper during the manufacture thereof and when drawing the carrier sheet through the impregnating and drying installations, are eliminated due to this stretching or elongation.

The term warm-deformable state or condition is understood, within the framework of the present invention, as that state of a synthetic resin-impregnated and/or coated carrier sheet in which the carrier sheet still has a temperature at which it is permanently and plastically deformable without an essential further condensation of the synthetic resin taking place. Generally, the warm-deformable state of the resin-carrying carrier sheet exists at a temperature of approximately 80°C up to, for a short time, 130°C. A temperature range of from 90°C to 120°C is preferred. At this temperature, the resin-carrying carrier sheets are still in the deformable state, and a compensation and rectification of the stresses present in the synthetic resin-impregnated and/or coated carrier sheet takes place by virtue of the stretching or elongation. Compensation of the stresses in the paper, which are caused by a varying fiber distribution, are also eliminated at the same time.

The stretching or elongation of the resin-carrying carrier sheets may take place in any desired manner, and the paper and textile technology offers a number of possibilities and solutions from which one may choose. For example, and preferably, the resin-carrying dried carrier sheets are passed over either one or several broad-drawing rollers, known per se, such as those conventionally used in the paper and textile industries, and these broad-drawing rollers may be used in combination with reversing rollers.

After the elongation, the film is cooled in a manner known per se, by blowing with air or by means of cooling rollers, and then stabilized at about 30°C, i.e. brought into a storable condition.

Of course, it is also possible to dry a carrier sheet which had been impregnated and/or coated in a customary manner, cool it and roll it, and to then heat the resin-carrying carrier sheet in a second working step, again to a temperature at which it will pass over or change over into a warm-deformable condition, and to thereafter stretch or elongate the thus heated carrier sheet, as proposed by the present invention.

The inventive process will now be further explained, hereinafter, on the basis of the accompanying drawing.

FIG. 1 shows that, in the process according to the present invention, the coated carrier sheet 1 is dried and precondensed in a drying channel 2, by blowing with hot air through air nozzles 3. The coated carrier sheet 1 is guided over the regulating rollers 4 and the warm-deformable sheet 1 is then elongated or stretched by means of broad-drawing rollers 5 and engaging rollers 6. The stretched sheet 1 is subsequently cooled to below 30°C by means of cooling rollers 8, guided over the reversing roller 9 and wound onto a roll 10. When the beginning of the film is passed through, the engaging rollers are lifted upwardly off the film and, when the film has been passed through, they are lowered again.

It will be obvious to those skilled in the art that many modifications may be made within the scope of the present invention without departing from the spirit thereof, and the invention includes all such modifications.

What is claimed is:

1. A process for making a carrier sheet of paper treated with an aqueous solution of at least one heat-hardenable aminoplast condensation resin, comprising passing said treated sheet through a heated zone in which said heat-hardenable aminoplast resin is dried and precondensed, stretching said treated sheet at a temperature in the range of about 80°C to about 130°C, and in a direction transverse to the grain direction of said sheet, and cooling said treated, stretched sheet.

2. A process according to claim 1 in which the treated sheet is cooled and reheated to the stretching temperature.

3. A process in accordance with claim 1 wherein the treated sheet is stretched by passing said treated sheet over at least one broad-drawing roller.

4. A process in accordance with claim 3 wherein the treated sheet is stretched by passing said treated sheet over at least one broad-drawing roller combined with at least one reversing roller.

5. A process in accordance with claim 1 wherein the temperature is between about 90° and 120°C.

6. A process in accordance with claim 1 wherein the treated sheet is stretched longitudinally with respect to the direction of the grain direction of the sheet.

7. A process in accordance with claim 1 wherein the treated sheet is stretched both transversely and longitudinally with respect to the grain direction of the sheet.

8. A process in accordance with claim 1 wherein the treated, stretched sheet is cooled by blowing with air.

9. A process in accordance with claim 1 wherein the treated, stretched sheet is cooled by passing the same over at least one cooling roller.

* * * * *